US007667153B2

(12) United States Patent
Steidle et al.

(10) Patent No.: US 7,667,153 B2
(45) Date of Patent: Feb. 23, 2010

(54) DOUBLE-POLE CHANGE-OVER SWITCH

(75) Inventors: Gerhard Steidle, Koenigsfeld (DE); Karl-Heinz Wohlfahrt, Bodman-Ludwigshafen (DE)

(73) Assignee: TRW Automotive Electronics & Components GmbH & Co. KG, Radolfzell (DE)

( * ) Notice: Subject to any disclaimer, the term of this patent is extended or adjusted under 35 U.S.C. 154(b) by 388 days.

(21) Appl. No.: 11/339,131

(22) Filed: Jan. 25, 2006

(65) Prior Publication Data

US 2006/0180453 A1 Aug. 17, 2006

(30) Foreign Application Priority Data

Jan. 31, 2005 (DE) ..... 20 2005 001 495 U

(51) Int. Cl.
*H01H 13/14* (2006.01)
*H01H 3/12* (2006.01)

(52) U.S. Cl. ..... 200/341; 200/5 R

(58) Field of Classification Search ..... 200/341
See application file for complete search history.

(56) References Cited

U.S. PATENT DOCUMENTS

| | | | | |
|---|---|---|---|---|
| 2,526,850 A | | 10/1950 | Charbonneau | |
| 2,916,575 A | | 12/1959 | Mais | |
| 3,736,395 A | * | 5/1973 | Miller | 200/406 |
| 5,343,008 A | * | 8/1994 | Ipcinski | 200/302.2 |
| 6,377,239 B1 | * | 4/2002 | Isikawa | 345/156 |
| 7,166,813 B2 | * | 1/2007 | Soma et al. | 200/600 |
| 7,282,656 B2 | * | 10/2007 | Niiyama | 200/5 R |

FOREIGN PATENT DOCUMENTS

| | | |
|---|---|---|
| DE | 7441251 | 12/1974 |
| DE | 2360167 | 6/1975 |
| DE | 2730659 | 8/1978 |
| DE | 2740875 | 3/1979 |
| DE | 3012107 | 10/1981 |
| DE | 4244707 | 4/1994 |
| JP | 2004031171 | 1/2004 |

* cited by examiner

*Primary Examiner*—Michael A Friedhofer
*Assistant Examiner*—Lheiren Mae A Anglo
(74) *Attorney, Agent, or Firm*—Tarolli, Sundheim, Covell & Tummino LLP

(57) ABSTRACT

A change-over switch for the switching of two electric circuits is disclosed, including a housing, a tappet, two contacts of a first electric circuit, two contacts of a second electric circuit, and a switching contact which comprises in an initial state a first shape in which said first electric circuit is closed and said second electric circuit is opened, and which by actuating said tappet may be transferred into a second shape in which said first electric circuit is opened and said second electric circuit is closed.

15 Claims, 8 Drawing Sheets

DOUBLE-POLE CHANGE-OVER SWITCH

The invention relates to a change-over switch for the switching of two electric circuits.

BACKGROUND OF THE- INVENTION

Such change-over switches may in particular be used in motor vehicles, for example as a make/break double-throw or double switch. The designs known from the prior art are, however, comparatively expensive.

It is the object of the invention to create a change-over switch which is distinguished by particularly low manufacturing expense, redundancy and reliability, and the possibility to simultaneously switch two independent switching circuits such that at least one pair of contacts closes and one pair of contacts simultaneously opens.

BRIEF DESCRIPTION OF THE INVENTION

In order to achieve this object, there is provided in accordance with the invention a change-over switch for the switching of two electric circuits, including a housing, a tappet, two contacts of a first electric circuit, two contacts of a second electric circuit, and a switching contact which comprises in the initial state a first shape in which the first electric circuit is closed and the second electric circuit is opened, and which by actuating the tappet may be transferred into a second shape in which the first electric circuit is opened and the second electric circuit is closed. The change-over switch in accordance with the invention is founded on the basic idea to switch two different electric circuits with one and the same switching contact and to use the transition of the switching contact from a first shape into a second one to close the contacts of a first electric circuit and open the contacts of a second electric circuit. Since only one single switching contact is required for this purpose, a simple structure which causes low manufacturing expense is achieved.

Advantageous designs of the invention will be apparent from the sub-claims.

BRIEF DESCRIPTION OF THE DRAWINGS

The invention will be described in the following with the aid of a preferred embodiment which is represented in the accompanying drawings in which.

DETAILED DESCRIPTION OF THE INVENTION

Figure 1:
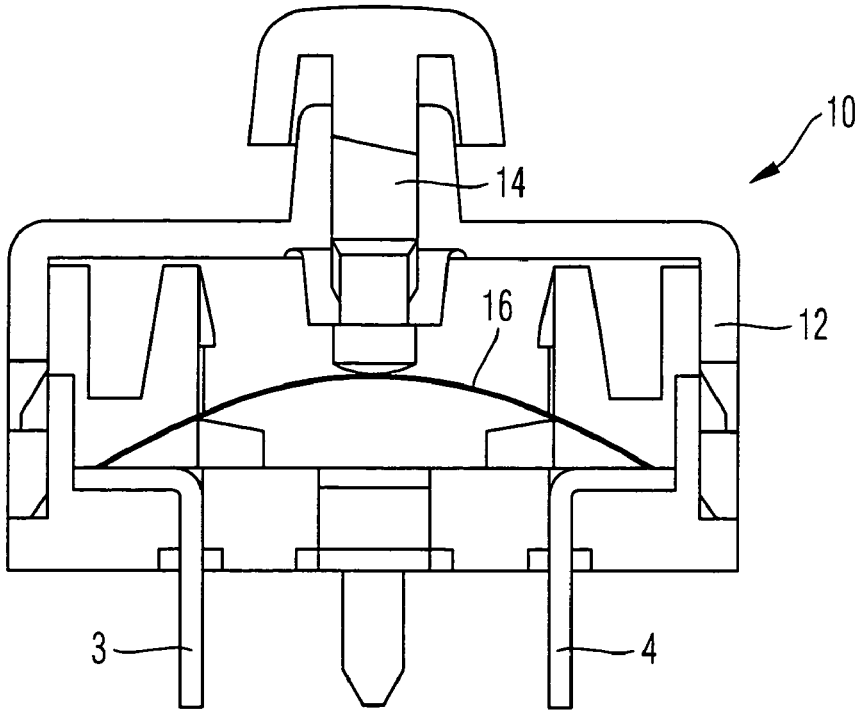
- FIG. 1 shows a schematic section through a change-over switch in accordance with the invention.
Figure 2:
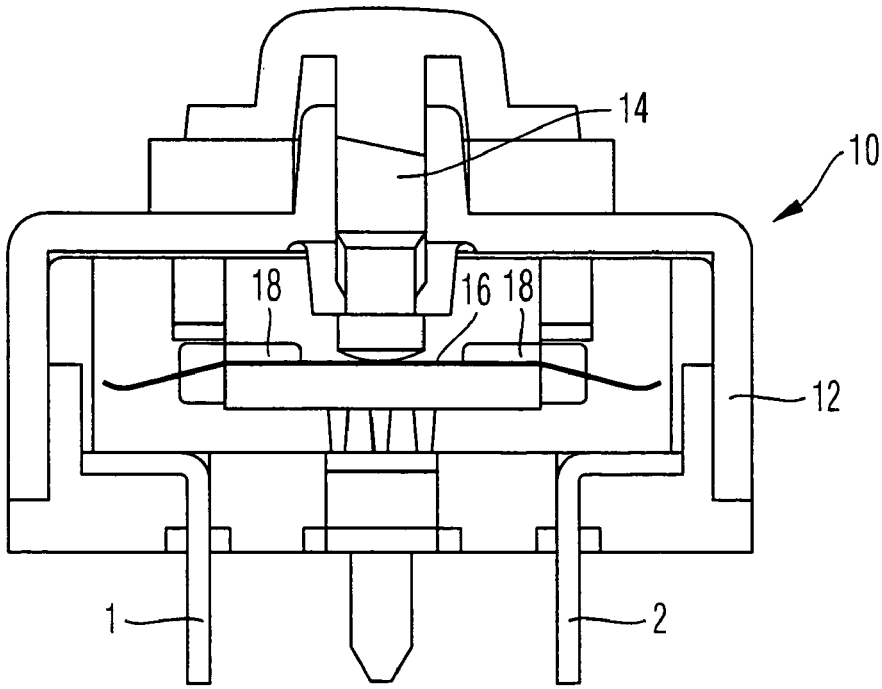
- FIG. 2 shows a section through the change-over switch of FIG. 1 rotated through 90°.

In FIGS. 1 and 2, there is shown a change-over switch 10 which comprises a housing 12 in which four contacts 1, 2, 3, and 4 to be switched are accommodated. A tappet 14 is displaceably mounted in the housing 12. The tappet 14 cooperates with a switching contact 16 that may open or close the electric contact between the two contacts 1, 2 which form a first electric circuit and the two contacts 3, 4 which form a second electric circuit.

Figure 3:
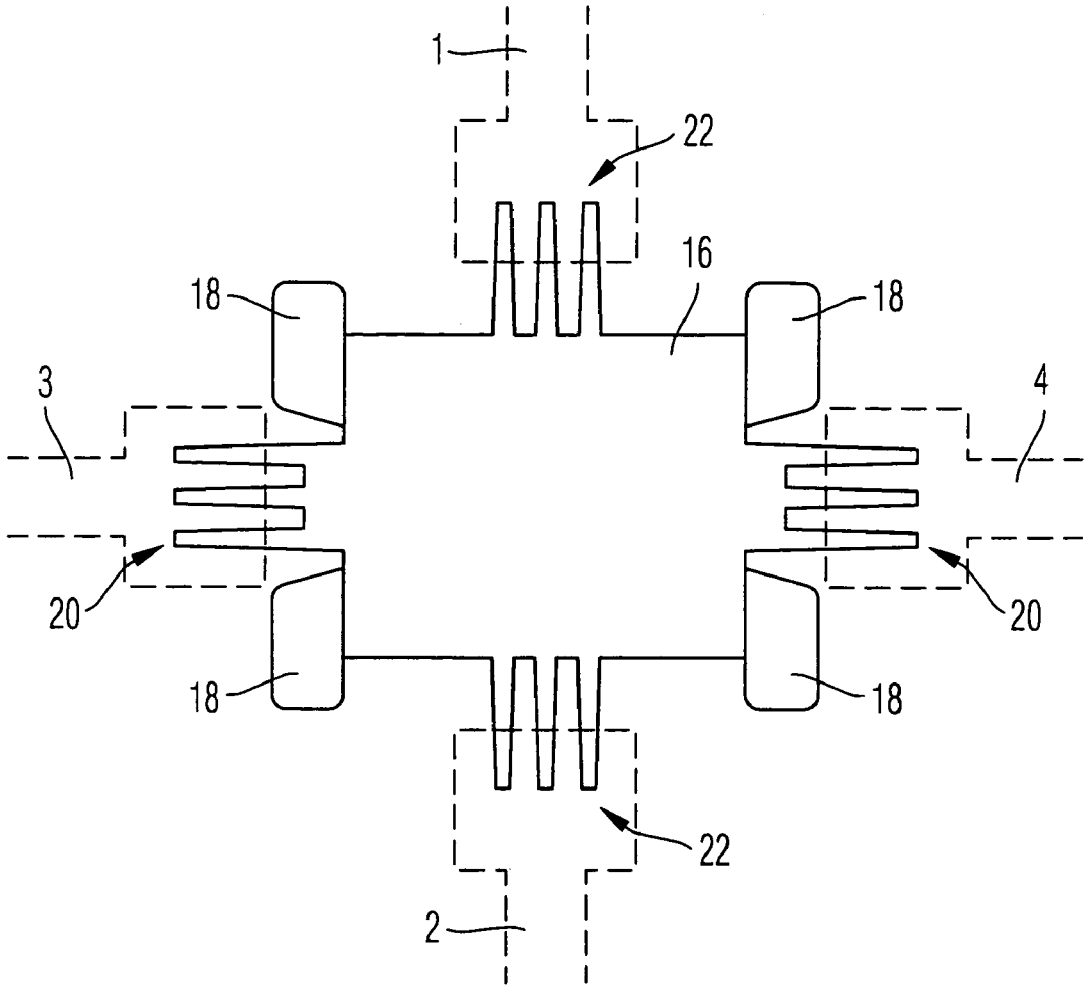
- FIG. 3 schematically shows the contacts switched by the change-over switch.
Figure 4:
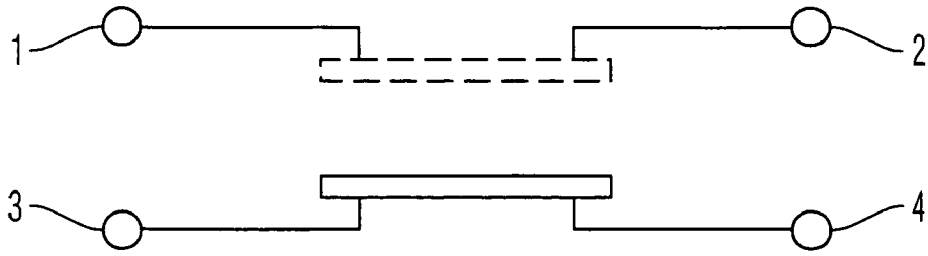
- FIG. 4 shows a further schematic view of the switched contacts.
Figure 5:
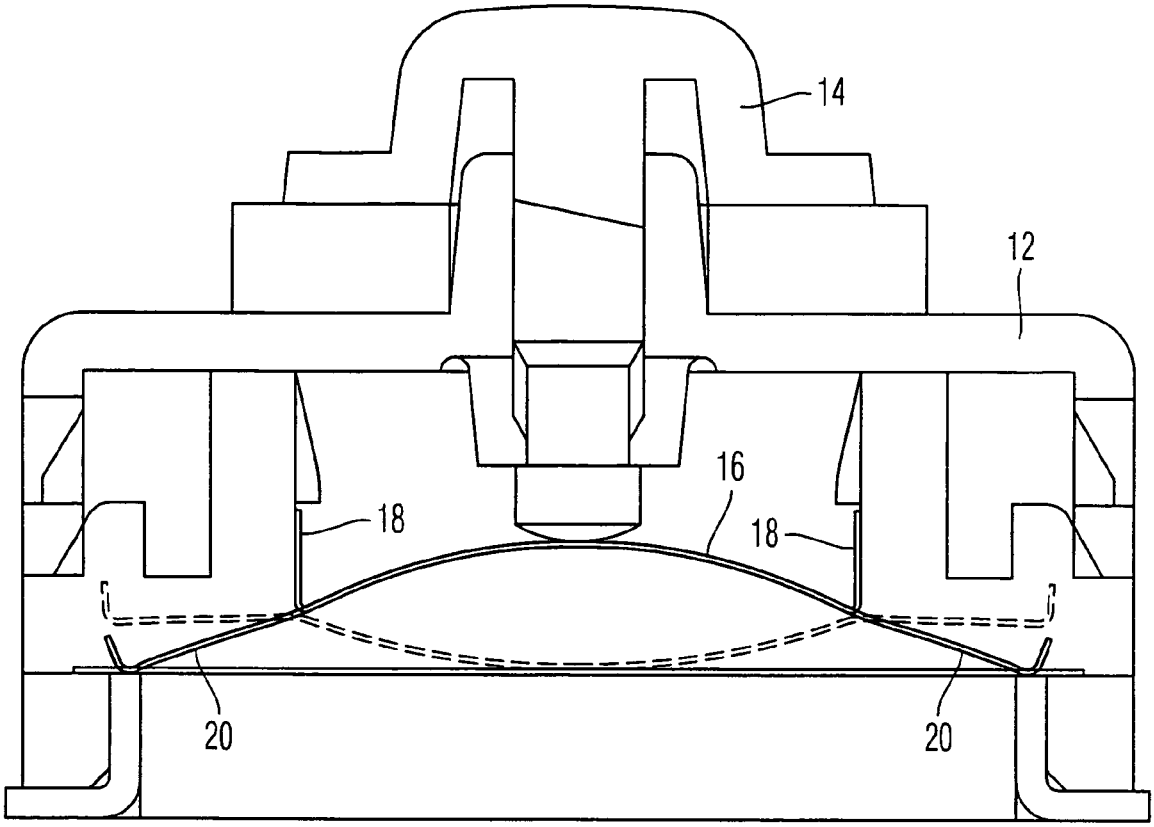
- FIG. 5 shows the view of FIG. 1 on an enlarged scale.
Figure 6:
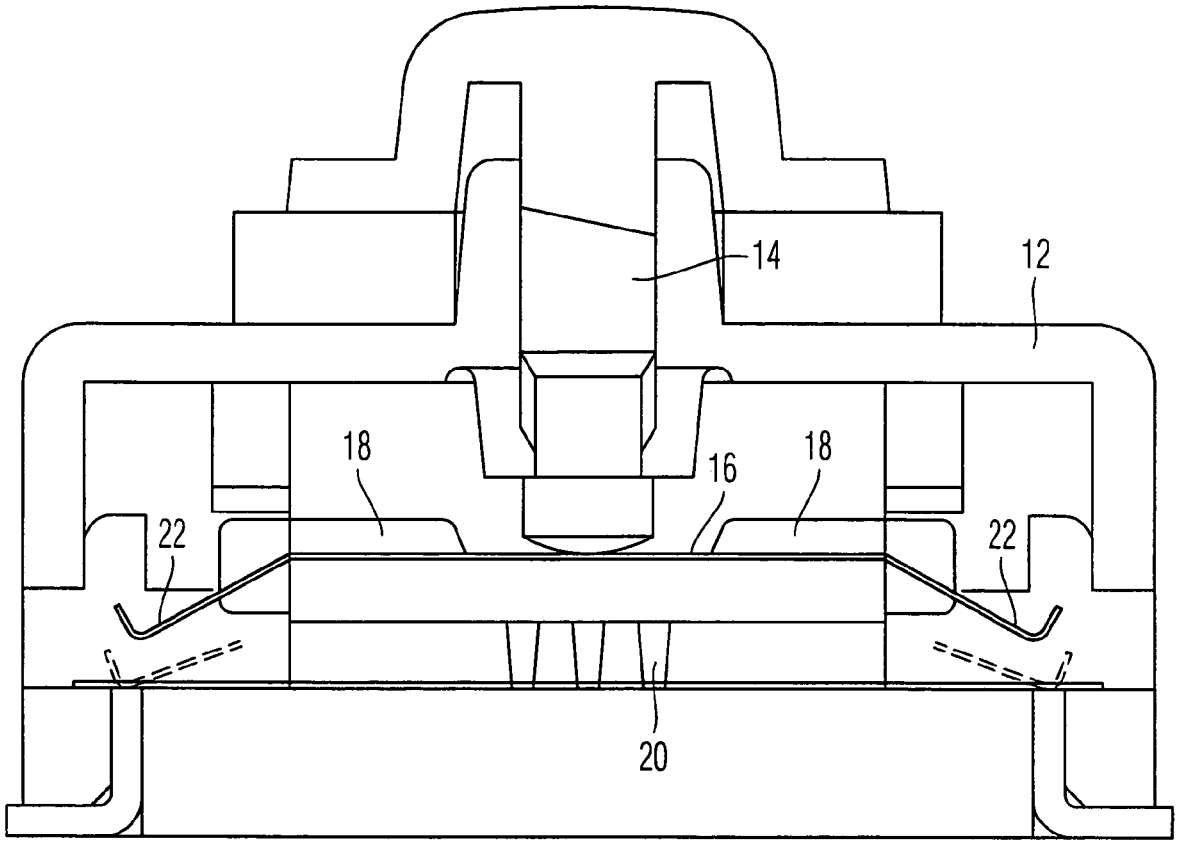
- FIG. 6 shows the view of FIG. 2 on an enlarged scale.
Figure 7:
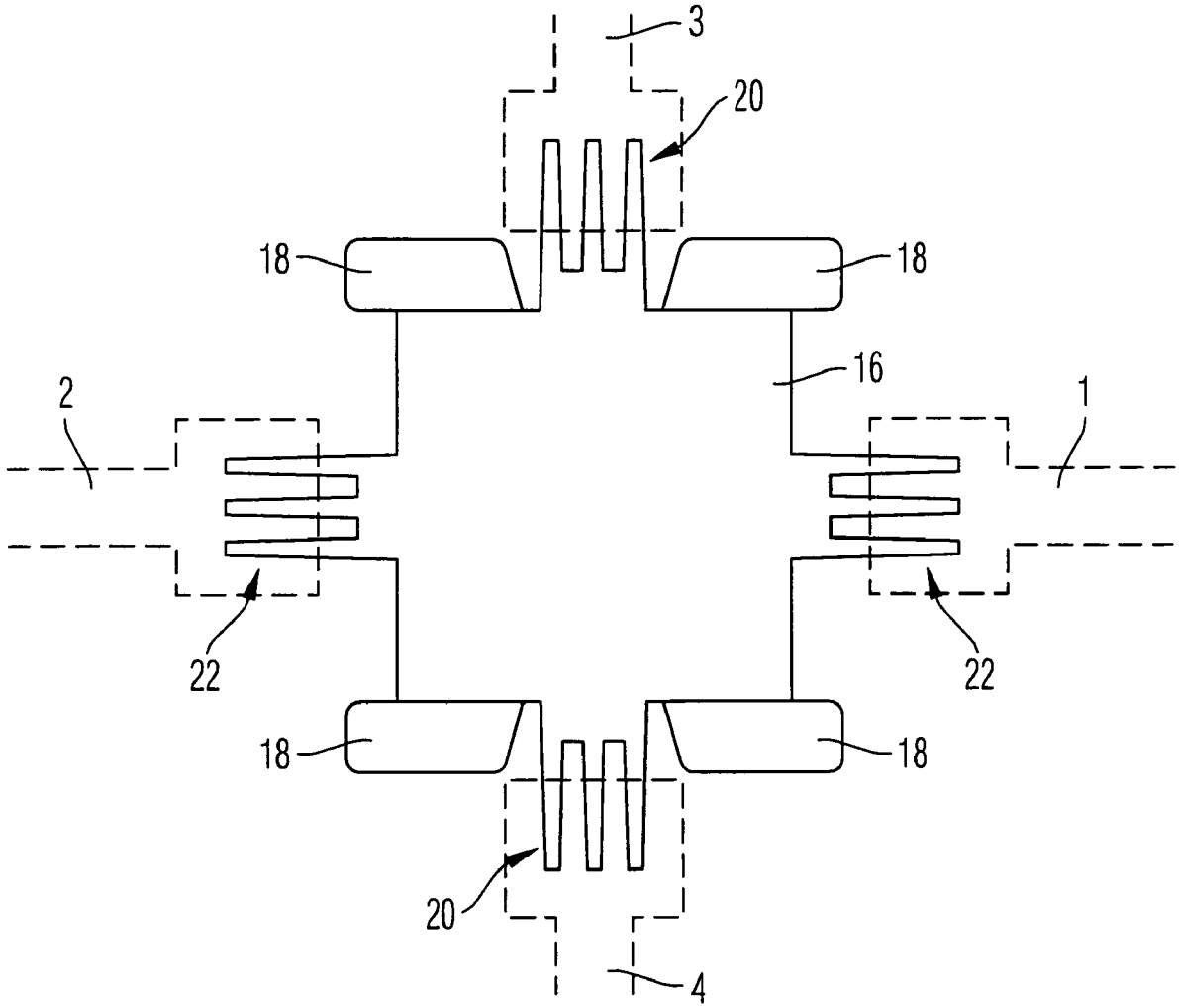
- FIG. 7 shows the view of FIG. 3 on an enlarged scale.

The switching contact 16 consists of spring steel sheet or another elastically resilient and electrically conductive material and has a generally rectangular basic shape (see FIG. 3). If viewed in a plane containing the contacts 3 and 4 (the representation of FIGS. 1 and 5), the switching contact 16 is arched in the initial state towards the tappet 14; it has the shape of a catch spring. Provided at the short side edges of the generally rectangular basic body of the switching contact 16 are holding lugs 18 by means of which the switching contact is attached to the housing 12. Outwardly extending between two adjacent holding lugs 18 each is one contact lug 20 each which is formed in this arrangement of 3 individual lugs each (see FIG. 3). In the initial position as shown in FIGS. 1 and 5, i.e. with the tappet 14 not being actuated, the contact lugs 20 rest against the contacts 3 and 4; thus, the electric circuit through the contacts 3 and 4 is closed (see also FIG. 4). In a plane leading through the contacts 1 and 2 (see FIGS. 2 and 6), the switching contact 16 has an approximately plane shape. Proceeding from the longer side edges of the rectangular basic body of the switching contact 16, the contact lugs 22, which are associated with the two first contacts 1, 2 and which likewise consist of a plurality of individual lugs, extend. In the initial state, i.e. when the tappet 14 is not actuated, the contact lugs 22 are spaced away from the first contacts 1, 2; thus, the first electric circuit formed by these contacts is opened.

When the tappet 14 is actuated, it presses on the center of the bow-shaped switching contact 16. The latter is transferred from its first shape, which is shown with continuous lines in FIGS. 5 and 6, into a second shape which is shown with broken lines in FIGS. 5 and 6. In the plane containing the contacts 3, 4, the switching contact 16 snaps downwards beyond a dead center against the holding force exerted by the holding lugs 18 so that the contact lugs 20 are lifted off from the contacts 3, 4; the second electric circuit formed by these contacts is thus opened (see the state of the switching contact 16 as shown in FIG. 5 in a broken line). At the same time the switching contact 16 is downwardly displaced substantially in translation in the plane containing the contacts 1, 2, so that the contact lugs 22 rest on the contacts 1, 2; the first electric circuit formed by these contacts is thus closed.

When the tappet 14 is again released, the switching contact 16 snaps back again into its first shape in which the first electric circuit formed by the contacts 1, 2 is opened and the second electric circuit formed by the contacts 3, 4 is closed.

Figure 8:
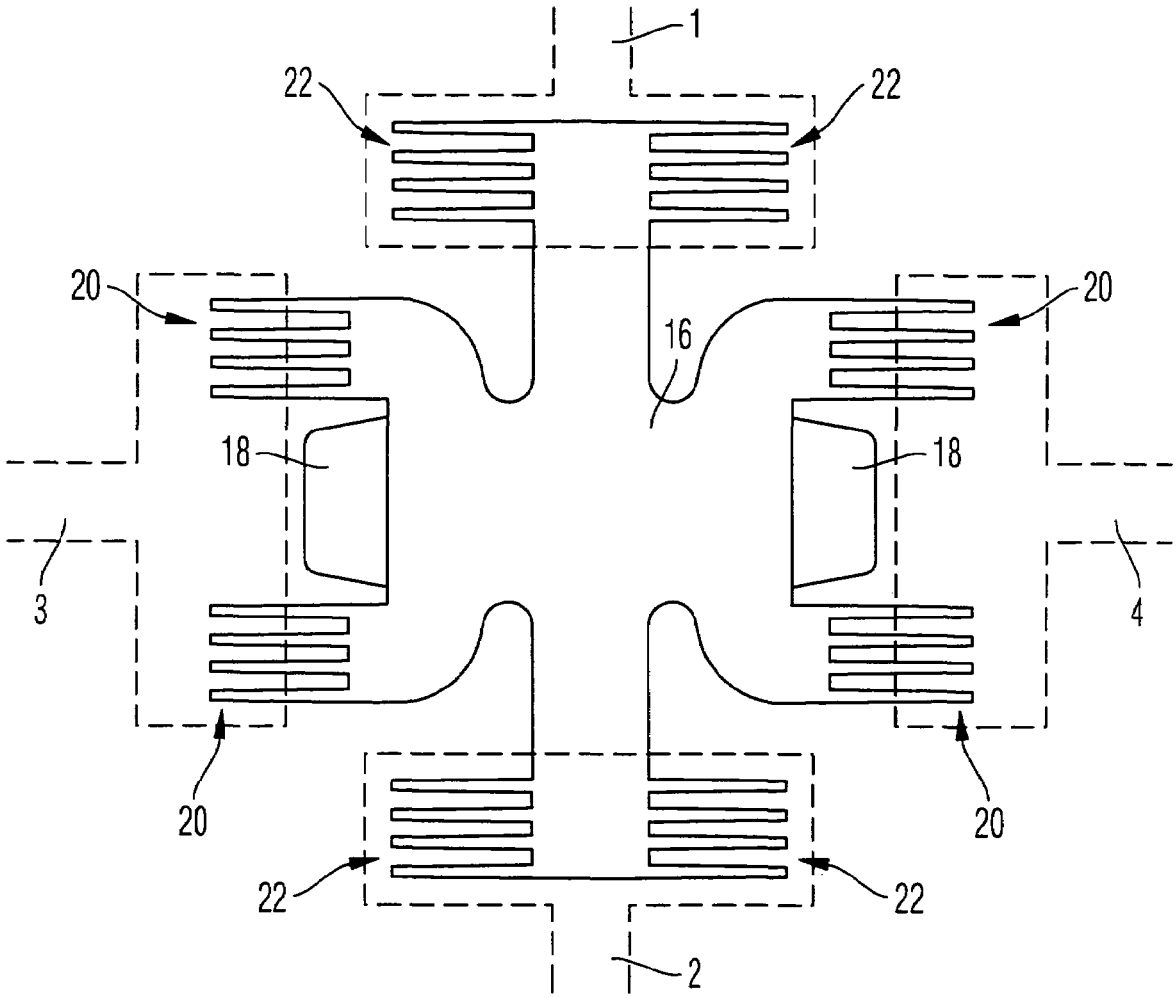
- FIG. 8 shows a variant of an embodiment in a view corresponding to that of FIG. 7.

In FIG. 8, there is illustrated a variant of an embodiment which differs from the first embodiment by the deviating design of the contact lugs 20, 22. Employed for the contacts 1, 2 are two mutually opposite contact lugs 22 each, which are formed in this arrangement of four individual lugs each. Employed for the contacts 3,4 are two contact lugs 20 each, which are situated on either side of the respective holding lug 18. Each contact lug 20 in turn consists of a plurality of individual lugs. In this manner a better contact reliability when making contact is achieved.

Figure 9:
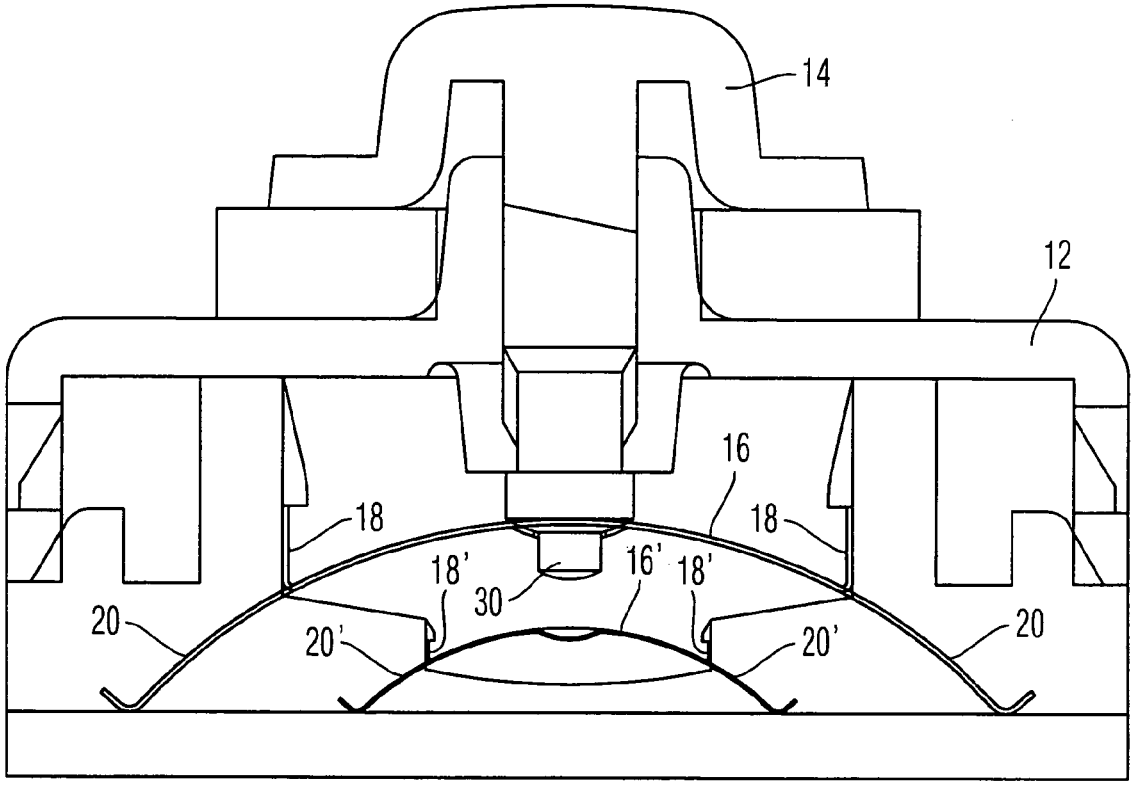
- FIG. 9 shows a change-over switch according to a second embodiment in a view corresponding to that of FIG. 5.
Figure 10:
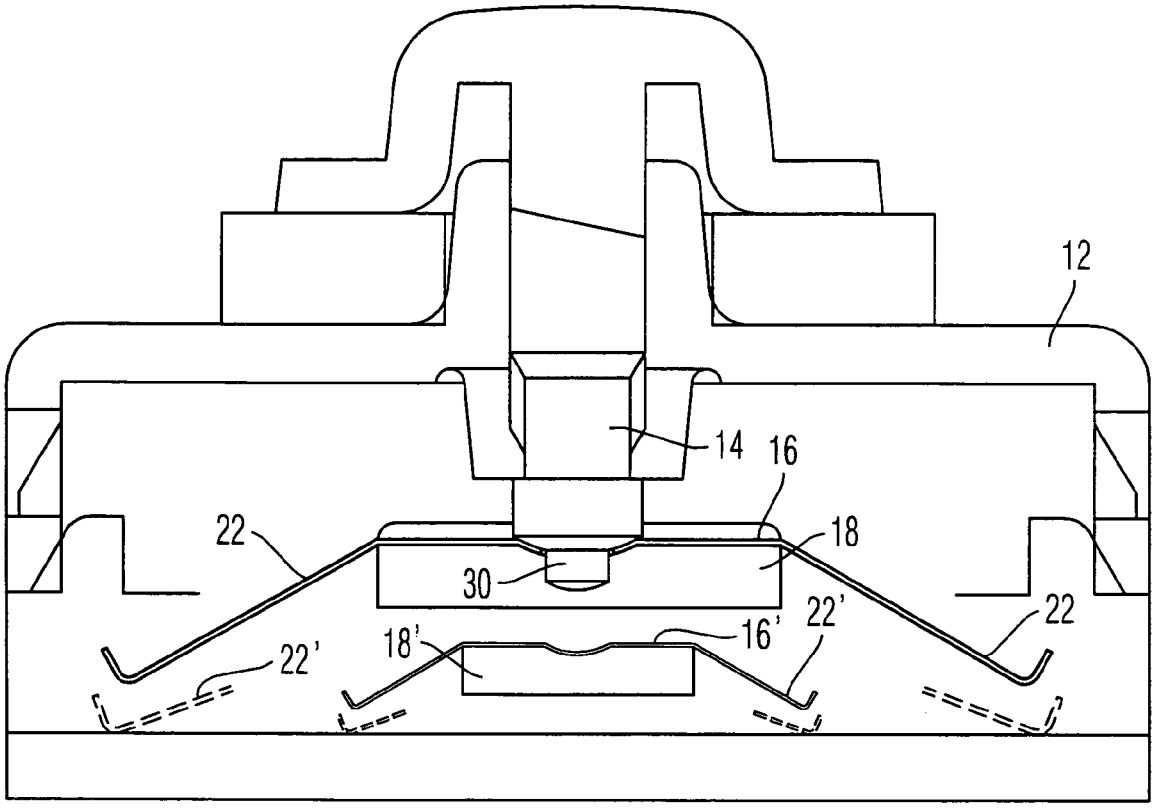
- FIG. 10 shows the change-over switch according to the second embodiment in a view corresponding to that of FIG. 6.

In FIGS. 9 and 10, there is shown a change-over switch according to a second embodiment. This change-over switch differs from the change-over switch according to the first embodiment by a second switching contact 16' being disposed below the switching contact 16. With regard to its shape and its function, the second switching contact 16' corresponds to the first switching contact 16, the difference being that the second switching contact 16' is configured in a reduced size so that it fits below the switching contact 16. It is actuated by an extension 30 which is formed on the tappet 14 and which extends through the switching contact 16 and engages the second switching contact 16'. In this manner twice the number of contacts may simultaneously be switched.

The invention claimed is:

1. A change-over switch for the switching of two electric circuits, including a housing, a tappet, two contacts of a first electric circuit, two contacts of a second electric circuit, and a switching contact which comprises in an initial state a first shape in which said first electric circuit is closed by said switching contact and said second electric circuit is opened, and which by actuating said tappet may be transferred into a second shape in which said first electric circuit is opened and said second electric circuit is closed by said switching contact, said switching contact including two contact lugs associated with said two contacts of said first electric circuit and two contact lugs associated with said two contacts of said second electric circuit, wherein said contacts of said first electric circuit and said contacts of said second electric circuit are substantially in the same plane.

2. The change-over switch according to claim 1, wherein in a plane in which said two contacts of said second electric circuit are situated said switching contact comprises in said initial state a shape arched towards said tappet.

3. The change-over switch according to claim 1, wherein in a plane in which said two contacts of said first electric circuit are situated said switching contact comprises in said initial state a substantially plane shape.

4. The change-over switch according to claim 3, wherein in said plane in which said two contacts of said first electric circuit are situated said switching contact is substantially moved in translation on account of an operation of said tappet.

5. The change-over switch according to claim 1, characterized in that as viewed in a direction of operation of said tappet a second switching contact is disposed behind said switching contact.

6. The change-over switch according to claim 1, wherein said switching contact comprises a single piece for closing said first electric circuit and said second electric circuit.

7. The change-over switch according to claim 1, wherein said contact lugs associated with said first electric circuit close said first electric circuit when said switching contact is in said first shape, said contact lugs associated with said second electric circuit closing said second electric circuit when said switching contact is in said second shape.

8. The change-over switch according to claim 7, wherein said contact lugs associated with said first electric circuit are diametrically opposed from one another and said contact lugs associated with said first electric circuit are diametrically opposed from one another.

9. A change-over switch for the switching of two electric circuits, including a housing, a tappet, two contacts of a first electric circuit, two contacts of a second electric circuit, and a switching contact which comprises in an initial state a first shape in which said first electric circuit is closed by said switching contact and said second electric circuit is opened, and which by actuating said tappet may be transferred into a second shape in which said first electric circuit is opened and said second electric circuit is closed by said switching contact, said switching contact including two contact lugs associated with said two contacts of said first electric circuit and two contact lugs associated with said two contacts of said second electric circuit, wherein in the plane which said two contacts of said second electric circuit are situated said switching contact comprises in said initial state a shape arched towards said tappet, wherein in the plane in which said two contacts of said second electric circuit are situated said switching contact is formed like a catch spring which may snap from said initial state beyond a dead center into said second shape.

10. A change-over switch for the switching of two electric circuits, including a housing, a tappet, two contacts of a first electric circuit, two contacts of a second electric circuit, and a switching contact which comprises in an initial state a first shape in which said first electric circuit is closed by said switching contact and said second electric circuit is opened, and which by actuating said tappet may be transferred into a second shape in which said first electric circuit is opened and said second electric circuit is closed by said switching contact, said switching contact including two contact lugs associated with said two contacts of said first electric circuit and two contact lugs associated with said two contacts of said second electric circuit, wherein in a plane in which said two contacts of said second electric circuit are situated said switching contact comprises in said initial state a shape arched towards said tappet, wherein said switching contact is attached to said housing by holding lugs which are situated in said plane of said two contacts of said second electric circuit.

11. The change-over switch according to claim 10, wherein said contact lugs associated with said second electric circuit are situated radially beyond said two holding lugs.

12. The change-over switch according to claim 11, wherein said contact lugs associated with said first electric circuit are pressed on said two contacts of said first electric circuit when said tappet is actuated.

13. The change-over switch according to claim 11, wherein said contact lugs consist of a plurality of individual lugs.

14. A change-over switch for the switching of two electric circuits, including, a housing, a tappet, two contacts of a first electric circuit, two contacts of a second electric circuit, and a switching contact which comprises in an initial state a first shape in which said first electric circuit is closed by said switching contact and said second electric circuit is opened, and which by actuating said tappet may be transferred into a second shape in which said first electric circuit is opened and said second electric circuit is closed by said switching contact, said switching contact including two contact lugs associated with said two contacts of said first electric circuit and two contact lugs associated with said two contacts of said second electric circuit, wherein in a plane in which said two contacts of said second electric circuit are situated said switching contact comprises in said initial state a shape arched towards said tappet, wherein said switching contact is attached to said housing by holding lugs which are situated in said plane of said two contacts of said second electric circuit wherein said contact lugs associated with said second electric circuit are situated radially beyond said two holding lugs, wherein when said tappet is actuated said contact lugs associated with said second electric circuit are lifted off from said two contacts of said second electric circuit.

15. A change-over switch for the switching of two electric circuits, including, a housing, a tappet, two contacts of a first electric circuit, two contacts of a second electric circuit, and a switching contact which comprises in an initial state a first shape in which said first electric circuit is closed by said switching contact and said second electric circuit is opened, and which by actuating said tappet may be transferred into a second shape in which said first electric circuit is opened and said second electric circuit is closed by said switching contact, said switching contact including two contact lugs associated with said two contacts of said first electric circuit and two contact lugs associated with said two contacts of said second electric circuit, wherein said contact lugs associated with said first electric circuit are positioned on a first pair of diametrically opposed sides of the switching contact, said contact lugs associated with said second electric circuit being positioned on a second pair of diametrically opposed sides of the switching contact different from the first pair of diametrically opposed sides.

* * * * *